United States Patent [19]

Anker

[11] 4,173,197

[45] Nov. 6, 1979

[54] VOLLEY BALL ROTATION COUNTER

[76] Inventor: Madylon C. Anker, Omaha, Nebr.

[21] Appl. No.: 859,082

[22] Filed: Dec. 9, 1977

[51] Int. Cl.[2] ..... A63B 71/06

[52] U.S. Cl. ..... 116/223; 116/312

[58] Field of Search ..... 116/133, 130, 120; 235/91 R; 224/28 R, 28 B; 213/85 R, 85 A, 148 R

[56] References Cited

U.S. PATENT DOCUMENTS

| | | | |
|---|---|---|---|
| 1,460,296 | 6/1923 | Welsh | 224/28 B |
| 2,134,039 | 10/1938 | Gibbs | 116/120 |
| 2,192,430 | 3/1940 | Branner | 235/91 R |
| 2,715,990 | 8/1955 | Austin | 224/28 R |
| 3,739,740 | 6/1973 | Fromer | 116/133 |
| 3,936,963 | 2/1976 | Chan | 116/120 |
| 3,941,080 | 3/1976 | Ford | 116/130 |

*Primary Examiner*—S. Clement Swisher
*Assistant Examiner*—Denis E. Corr
*Attorney, Agent, or Firm*—Hiram A. Sturges

[57] ABSTRACT

A volley ball rotation counter for keeping track of the rotation of the serve, having right and left rotatable upwardly facing discs capable of receiving visible removable markings, the discs having indicia thereon indicating six symbolic playing positions on each disc and spaced around the axis of each disc, disc rotation retarding devices mounted on a frame and for resisting accidental disc rotation and permitting said discs to be rotated manually in clockwise directions when an operator manually engages an edge of a disc to urge said disc into rotation.

10 Claims, 2 Drawing Figures

VOLLEY BALL ROTATION COUNTER

BACKGROUND OF THE INVENTION

In volley ball tournaments, there has been no handy way to keep track of the rotation of the players from position to position in the rotation under required. For example, if a player is properly to be in the center front position and he is in another position, then that is occasion for a penalty. The penalty is serious. The penalty is either that the serving team loses its serving privilege, or if the receiving team is in violation, then the serving side receives the point in order to penalize the receiving side.

At the time a ball is served, it is necessary for the players of the teams each to be in his proper position. Once the ball has been served, then the players of either team can be in any position they wish.

The more frequent problem is the overlapping of players in which a player is touching the floor in an area in which another player is properly positioned. At such times, the umpire needs to know exactly what position each player should be in. Heretofore, the only way of keeping track of this was on pieces of paper, which is such a slow process that most of the time an umpire who sees an overlap cannot rule on it because he does not known who should be where. And this is true even of the most serious competition and the very best referees. It is true in state tournaments and college ball even.

It is an object of this invention to provide a counter with two rotating discs with indicia indicating six symbolic playing positions on each disc so that an umpire can mark on a disc beside a playing position the playing number of the player who is in that position. It is my concept that the rotating discs make it possible to shift the players from position to position with one single motion of a disc, by simply rotating it. This then substitutes for the previous need to move each player on paper from one position to another, making a very slow and hopeless scramble.

A particular object hereof is to provide more fair volley ball competition.

Heretofore, the rule on proper rotation has been substantially unenforceable, almost as though the rule had never been made.

I have conceived that if the first playing position is the serving position at right back and then assigning the right forward playing position the numeral 2, the center forward position the numeral 3, etc., rearwardly in the rotation of players, a way is provided for keeping track. When a substitution is made, it is the rule that any future substitutions must be for that same serving position. This is a standard rule of the prior art.

Another rule of the game is that substitution can only be done two more times after the first entry at the start of the game.

With my counter, it is possible to tell at a glance how many times and at what position a player is being entered.

For example, if the playing position on a disc has had the numeral 3 marked on it in removable marking ink, then that means that player No. 3 has been entered at that position once. When the numeral 3 appears three times at that position, then the umpire must rule that he can no longer be entered at that position, nor at any position until that game is over.

It is necessary for the umpire and referee to know at all times who the captain of the team is. The position the captain is in at the start of a game can be marked at a position station on the respective disc by placing a numera "C" on the disc at that station. Whenever that player leaves the game, it is required for him to designate the new floor captain so that the umpire can mark the disc for the new floor captain.

I have conceived that by turning my counter upside down on one's arm at the eighth point of the third game, when by the rules, it is required that the team switch sides of the court, that both teams will be in proper rotation automatically by just turning my counter on one's arm. I have perceived that the rotation will still go clockwise and everything will move as before, even though the counter is upside down now on the umpire's wrist.

A further object is to provide a counter which can be worn either on the wrist or on the neck on a string or even on the referee's belt.

A further object is to provide straps so arranged and made of elastic material that they are adapted to fit either a large wristed or small wristed umpire without any adjustment.

In state tournaments, a third official is needed and my counter makes a very handy way for the third official to keep track of players, also.

A further object of my invention is to provide on the top of the counter two sets of numerals 1, 2, and 3. Each of these sets is on a different side of the net and these numerals can then refer to a first time-out, second time-out and third time-out. All the umpire need do is to take a felt marking pen which fits on the counter and cross out whichever numeral applies.

A particular object is to provide a holder for keeping a felt marking pen on the counter, so that in the rush of things, there is no tendency to mark up one's shirt accidentally by having to keep a marking pen on one's shirt for storage.

Yet another object is to provide disc-retarding means to keep the discs from coming out of place. One does not want this, and my concept is to use spring-positioned detent-engaging elements fixed to the frame engaging notches in the respective discs so as to automatically be received in a respective notch or detent. Then, by having six detents per each disc, it is possible to make each rotation the exact number of degrees for carrying out the positioning needed even in the speed of the game umpiring.

Still another object is to provide for the detent-engaging members to be so constructed as to prevent the disc from rotating in the undesired counter-clockwise direction.

A further object is to position a disc with respect to the frame so that each disc protrudes from the frame in such a way that a notch is in the middle of that portion of the disc which protrudes beyond the frame. Therefore, the umpire, in the speed of the game, can feel the notch with his finger, even without looking and can rotate the disc until the next notch is in the same position. This is a great convenience.

Still another object is to provide on one of the player-position stations on each disc a special mark to indicate serving position 1.

There is a rule that is very, very seldom enforced called the "spiking" line violation. In it the back line players, at the time they hit the ball, must not be on or in front of what is called the "spiking" line, unless they are hitting a ball that is lower than the net, or unless the ball they hit does not go over the net.

SUMMARY OF THE INVENTION

A volley ball rotation counter having a frame, right and left rotatable upwardly facing discs capable of receiving visible removable markings, mounting devices for mounting the discs for rotation on said frame about vertical axes, disc rotation retarding devices operably correlated with said frame and said discs, and with said disc mounting devices for resisting accidental disc rotation, the disc rotation retarding devices preferably being two detent-engaging elements, one engaging an outer edge of each disc respectively, and engageable in spaced notches in the edge of each disc, the detent-engaging elements being resilient, and being biased for automatically entering the detents of the respective disc, and being arranged and characterized for permitting disc rotation only in a clockwise direction, as seen from the top, the discs having markings thereon, indicating six symbolic playing positions on each disc, the positions being spaced around the axis thereof, preferably equi-distantly.

DESCRIPTION OF THE PREFERRED EMBODIMENT

Figure 1:
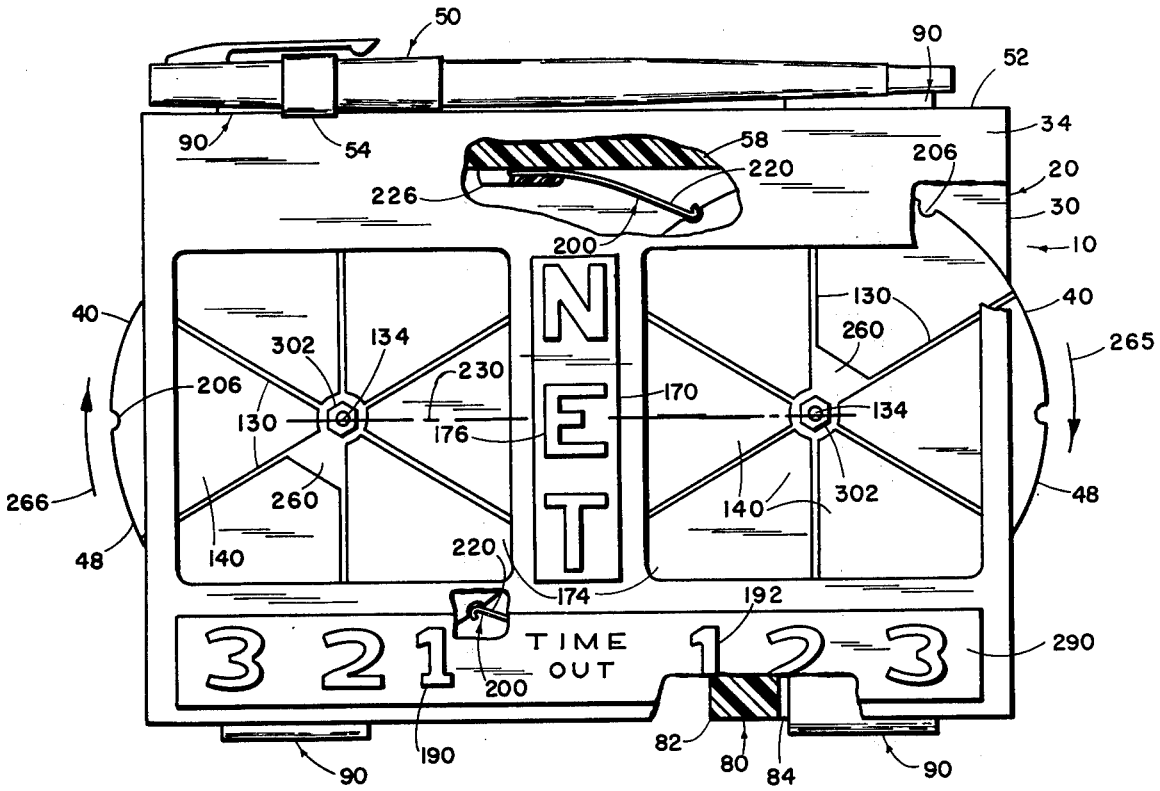
FIG. 1 is a top plan view of the volley ball rotation counter of this invention, shown with certain rearward portions of the upper cover broken away and other parts showing thereunder in section, with portions thereof broken away, and forward portions of the upper cover and back frame member being broken away, and also an upper portion of a left end of a right strap support being broken away, and the remainder showing in section.

Referring to FIG. 1 the volley ball rotation counter of this invention is there generally indicated at 10 comprising a frame, generally indicated at 20, the latter having a bottom frame member 30, and a top frame member or cover 34.

Two rotatable discs 40 disposed alongside each other, and defining right and left discs, having upper surfaces 48, capable of receiving visible, removeable markings. I have found that the use of thermoplastic material for making the discs is satisfactory if the markings to be put thereon are done with a common conventional felt-tipped fountain pen.

It is a part of this invention to provide a felt-tipped pen, generally indicated at 50, start adjacent the rearward edge 52 of the frame 20, as best seen in FIG. 1, with the pen 50 received in a pen-receiving loop 54, having ends attached by a screw 56 to the frame 20, and specifically to a rearward spacer 58, which extends from left to right along the rearward side 52 of the counter 10 and is disposed partly between the lower frame member 30 and upper frame member 34, the lower frame member 30 being fixed by a suitable bonding material 60 to a forward side of the rearward spacer 58 of the frame, which latter is abutted by the lower frame member 30.

At the forward side of the frame there is a forward spacer 66 which is also abutted by the lower frame member 30 and specifically by the forward edge of the lower frame member 30, such as 68, and glue or other suitable bonding material is used at 70 to secure the lower frame member 30 to the forward spacer 66, which latter extends from left to right along the forward edge of the frame 20.

The discs 40 are disposed between and spaced from the spacers 58 and 60.

The spacers 58 and 66 extend downwardly below the bottom frame member 30 somewhat, and strap holders 80 are attached to the spacers 58 and 66, respectively, there being a right and left forward strap holder 80, and a right and left rearward strap holder 80 also.

Each strap holder 80 has two upwardly extending side portions, one of which is illustrated at 82, the side portions being spaced apart for providing a recess 84 in the upper side of each holder 80 for receiving therethrough the upper portion of respective left and right straps 90, which latter each form an endless loop because the material is overlapped at 92 and fixed together, the material of the strap 90 that is.

The recesses 84 are bounded on the upper side by the spacers 58 and 66, respectively, whereby the recesses 84 tend to form strap holes, which confine the straps 90 each to the respective strap hole 94, formed at the respective recess 84.

As thus described, each strap 90 is confined because its forward and rearward ends extend through forward and rearward holders 80 at the respective left and right sides of the frame 20. Each strap 90 extends through its strap holes 94, then downwardly around the forward side of the forward respective strap holder and around the rearward side of the rearward respective strap holder, so that each strap has an upper portion 98 and a lower portion 99, which extend horizontally.

The straps 90 are particularly effective, because a person with a large wrist can insert his wrist between the lower portion 99 of each strap, and the upper portion 98 thereof; whereas a person with a small wrist can insert his wrist between the upper portion 98 of each strap and the bottom 30 of the frame, which is more confined and will hold a smaller wrist more firmly.

Each disc has marking indicia 130 thereon, which can be lines extending radially outwardly from the respective axes 134 of the respective disc.

The marking lines 130 can be called position marks 130, since they each indicate one side of a space 140. Since there are six of the positions marks or lines 130, and they are equi-distantly spaced about the respective axis 134, therefore, the spaces 140 are each of the same size, and each can be called a position space 140, and each is suitable for writing thereon, not shown, the writing being made by the felt pen 50, as the umpire marks in the spaces 140 the number of the player who is in the position on the playing court, not shown, which corresponds to the position space 140 on the respective disc 40.

Each disc 40 represents a different one of the two teams playing and the cover 34 of the frame 20 has a portion 170 disposed between two preferably rectangular openings 174, which latter are centered upon the axis of a respective disc 40. The openings 140 serve to make portions of each disc 40 visible. Because the openings 140 are rectangular they do a better job of representing the two sides of a volley ball court which are rectangular, and compensate for the fact that the discs 40 are necessarily circular or the equivalent of being at least almost circular.

Figure 2:
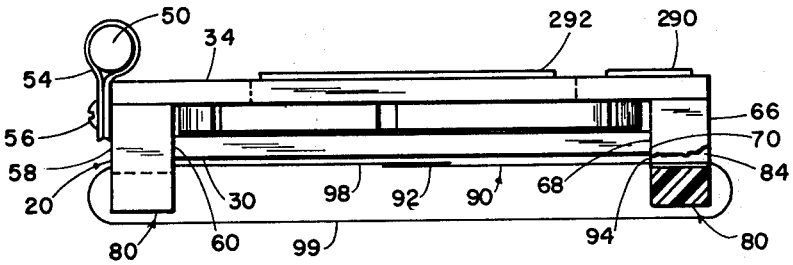
FIG. 2 is a left end view of the volley ball rotation counter of FIG. 1, but shown with a left end of a left forward strap holder broken away, and the remainder showing in section.

Each disc 40 has flat upper and lower surfaces closely, but slidably, fitted between the back frame portion 30 and the cover 34 of the frame, as best seen in FIG. 2.

That portion of the cover 34 which is disposed between the openings 174 can be seen at 170, and can represent the net that is between the two sides of the playing court and for that reason the letters of the word "net" are shown at 176 printed on the upper side of the intermediate portion 170.

A portion of the cover 34, which is disposed below the left opening 174, bears the indicia 1, 2 and 3, as shown at 190, with the 1 nearest the net, 2 farther out and 3 the farthest from the net.

The numerals 190 represent "time out" periods and it is desirable that the numerals 190 and the cover 34 be of such materials that the felt pen 50 can be used to cross out the numerals 190 sequentially as that respective "time out" period has been used up.

On the right side of the cover 34 beneath the right opening 174 are similar numerals 192, representing the "time outs" for the team that is playing on the right side of the volley ball court, as represented by the right opening 174.

A pair of rotating retarding devices are generally indicated at 200, one for the right disc 40 and one for the left disc 40. The rotation retarding devices 200 each comprise having a plurality of spaced detents on the outer edge of each disc 40, indicated at 206, which latter are equidistantly spaced around the periphery of each respective disc 40 and are disposed preferably exactly at the center between each two of the position lines 130, each detent extending from top to bottom in the edge of the periphery of the disc 40, respectively.

In each detent 206 is received a resilient detent-engaging member 220, of which there are two, one for each disc. The detent-engaging member 220 for the right disc of FIG. 1, therefore, extends rearwardly toward the edge 52 of the frame, and to the left at an inclination with respect to a line 230, drawn between the axes 134, the left end of the elongated resilient spring or detent-engaging member 220 for the right disc 40 is anchored to the frame 20 at the spacer 58 by suitable means 226.

A similar construction is used for the detent-engaging 220 which applies to the left disc 40, although it will be seen that it inclines in an opposite direction than the detent-engaging member 220 for the right disc 40.

The remainder except for an end portion of the left disc 40 detent-engaging member 220 is not shown, but it is to be understood that its construction is similar to that of the one for the right disc 40, and that it is similarly anchored to the frame.

Referring again to the discs 40, it can be seen that one of the position spaces 140 on each disc is provided with a special server marking 260, which latter is to be placed in the corresponding position of a server on a volley ball court, preparatory to the beginning of play.

As the play proceeds and the players shift their positions, they will be found to rotate on the court in a corresponding manner to the rotational position of the movement of each of the server markings 260, namely, clockwise in the direction of the arrow 264, for the right disc 40 and counter-clockwise in the direction of the arrow 266 for the left disc 40.

If desired, the "time out" numerals 192 can be mounted directly on the top of the cover 34, and special transparent thermoplastic covering, seen at 290, can be used to cover the numerals 192 to protect them, and to receive the felt markings thereon when the numerals 190 are to be crossed out.

A similar piece of clear plastic 292 can be glued to the cover 34, just as the piece 290 is, the piece 292 being used to cover the letters of the word "Net," as seen at 196.

The discs 40 are rotatably secured to the back member 30 of the frame 20 by means of bolt assemblies 302.

I claim:

1. A volley ball rotation counter comprising a frame having upper and lower interconnected frame means, two rotatable discs alongside each other and comprising right and left discs capable of receiving visible removeable markings, means rotatably mounting said discs on said lower frame means for rotation about parallel spaced axes between said upper and lower frame means, marking means on said discs indicating six symbolic volleyball playing positions on each disc and spaced around its axis, said upper frame means providing access to each of said discs for the writing of player indicia thereon on each of said playing positions simultaneously, said upper frame means having viewing means thereon extending across the top of each of said discs, said upper frame means permitting all of said volleyball playing positions to be at least partially viewable simultaneously, a portion of the periphery of each of said discs extending beyond said upper frame means, means operably correlated with said discs and with said frame and with said mounting means for retarding rotation of said discs and yet permitting said discs to be rotated manually in a clockwise direction when an operator manually engages an edge of a disc to urge said disc into clockwise rotation.

2. The volley ball rotation counter of claim 1 having said disc rotation retarding means comprising each disc having six detents spaced around its axis, two detent-engaging elements each having at one end a detent-engaging portion engageable in the detents of a different one of said discs, said detent-engaging elements having opposite ends which are fixed to said frame, said detent-engaging elements being resilient and being biased for automatically entering said detents of the respective disc, said detent-engaging members each permitting disc rotation only in a clockwise direction as seen from the top.

3. The volley ball rotation counter of claim 1 having each disc provided with indicia thereon indicating six symbolic playing positions on each disc, said playing position indicia being spaced around the axis of the respective disc.

4. The volley ball rotation counter of claim 1 having strap means attached to the bottom side of said frame for attaching said counter to an umpire's wrist.

5. The volley ball counter of claim 1 having an endless strap provided with upper and lower generally horizontally extending portions, a pair of strap holders disposed in spaced positions on said frame and secured to the underside thereof, said strap holders and said frame defining a holder and frame assembly, said holder and frame assembly having two strap openings extending therethrough in alignment with each other, one side of said endless strap extending through said openings and said endless strap being sufficiently short that when a person having a small wrist extends his wrist between said strap and said bottom of said frame at the center of said frame as seen in top plan view then the strap will effectively hold said counter on to the person's wrist and whereby when a person with a large wrist inserts his wrist between upper and lower sides of said strap, said strap will effectively hold said counter on to the person's wrist, said strap being made of elastic material.

6. The volley ball rotation counter of claim 5 having a second set of strap holders attached to said frame in a spaced relation to said first strap holders and having a second strap secured to said second strap holders, said second strap being disposed in parallelism to said first strap.

7. The volley ball rotation counter of claim 1 having a holder attached to said frame suitable for receiving and holding an elongated pen.

8. The volley ball rotation counter of claim 1 having a marking pen, and means removeably attaching said marking pen to said frame.

9. The volley ball rotation counter of claim 1 in which said discs each have a special marking thereon adjacent a playing position thereon designated by said playing position markings for indicating a serving position.

10. The volleyball rotation counter of claim 1 in which said upper frame means has two apertures extending vertically through it, said apertures providing access to said discs respectively sufficient for the writing of player indicia on each of said discs and on each of said playing positions simultaneously.

* * * * *